US011834800B2

(12) United States Patent
Elgammal

(10) Patent No.: US 11,834,800 B2
(45) Date of Patent: Dec. 5, 2023

(54) OFFSHORE OIL SPILL COLLECTOR DURING FLARING OPERATION

(71) Applicant: SAUDI ARABIAN OIL COMPANY, Dhahran (SA)

(72) Inventor: Shaker Moustafa Elgammal, Al Khubar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 249 days.

(21) Appl. No.: 17/085,663

(22) Filed: Oct. 30, 2020

(65) Prior Publication Data

US 2022/0136197 A1 May 5, 2022

(51) Int. Cl.
*E02B 15/08* (2006.01)
*E21B 41/00* (2006.01)

(52) U.S. Cl.
CPC ..... *E02B 15/0835* (2013.01); *E21B 41/0071* (2013.01)

(58) Field of Classification Search
CPC .... E21B 41/0071; E21B 15/02; E21B 41/005; F23G 7/05; F23B 5/04; F23B 5/00; F16N 31/006; F16N 31/002; B05B 14/00; B05B 14/40; B05B 14/48; B67D 7/0476; B67D 7/0492; E02B 15/0835
USPC ..... 431/117, 118, 119
See application file for complete search history.

(56) References Cited

U.S. PATENT DOCUMENTS 3,169,605 A * 2/1965 Ashmead ..... F16N 31/002 180/69.1
3,664,429 A * 5/1972 Jones ..... A62C 3/00 169/69
3,914,094 A 10/1975 Landry
4,431,382 A * 2/1984 Edman ..... F23K 5/04 431/65

(Continued)

FOREIGN PATENT DOCUMENTS

KR 101422766 B1 7/2014
KR 20170050280 * 5/2017 ..... B63B 35/44

(Continued)

OTHER PUBLICATIONS

Kang et al., Kang KR20170050280 Machine Translation, 2017, Korean Intellectual Property Office (Year: 2017).*

(Continued)

*Primary Examiner* — Alfred Basichas
(74) *Attorney, Agent, or Firm* — Osha Bergman Watanabe & Burton LLP

(57) ABSTRACT

An apparatus for collecting spilled liquid hydrocarbons includes a support beam coupled to an oil rig, the support beam positioned below a flare boom, and a spill pan coupled to an end of the support beam, the spill pan positioned below a burner nozzle of the flare boom. A method includes coupling an oil spill collector to an offshore rig below a flare boom, the oil spill collector including a support beam coupled to the offshore rig and a collection device coupled to an end of the support beam, positioning the collection device below a burner nozzle of the flare boom such that the collection device is horizontally aligned with the burner nozzle, and collecting spilled liquid hydrocarbons in the collection device from the flare boom.

18 Claims, 4 Drawing Sheets

(56) References Cited

U.S. PATENT DOCUMENTS

| | | | | | |
|---|---|---|---|---|---|
| 4,490,105 | A * | 12/1984 | Hunsberger | F23K 5/04 | 431/65 |
| 5,057,004 | A * | 10/1991 | McAllister | F23G 7/05 | 431/117 |
| 5,842,529 | A | 12/1998 | Dietzen | | |
| 5,919,036 | A * | 7/1999 | O'Brien | B01D 45/04 | 431/2 |
| 9,051,118 | B2 | 6/2015 | Jacobson | | |
| 2007/0077528 | A1* | 4/2007 | Sheridan | F23G 7/08 | 431/202 |

FOREIGN PATENT DOCUMENTS

| | | | |
|---|---|---|---|
| KR | 20170050280 | A | 5/2017 |
| WO | 2021003095 | A1 | 1/2021 |

OTHER PUBLICATIONS

International Search Report and Written Opinion issued in Application No. PCT/US2021/057243, dated Jan. 19, 2022 (15 pages).
McMurray et al.; "A Guide to Flare System Design, With Particular Reference to Offshore Platforms", OTC 3909; Offshore Technology Conference; May 5, 1980; pp. 547-555 (9 pages).

* cited by examiner

OFFSHORE OIL SPILL COLLECTOR DURING FLARING OPERATION

BACKGROUND

Offshore oil rigs are large structures that include equipment and facilities for drilling oil wells in the seabed to explore, extract, store, and/or process petroleum and natural gas. There are various types of offshore oil rigs including, for example, drilling barges, submersibles, fixed platforms, jackup rigs, tension leg platforms, spar platforms, etc. Offshore rigs generally include a derrick to support a drillstring, a rotary table or top drive to provide power to turn the drillstring, drawworks to reel out and reel in a drilling line, power generation equipment, mud tanks, and mud pumps.

Extraction and production of petroleum crude oil also results in the production of natural gas and other associated petroleum gases. Many offshore rigs do not have the equipment or ability to transfer or process all of the produced natural gas. Gases that cannot be processed or sold or that result from offshore well testing are flared. Flaring the gases helps reduce the threat of poisoning (inhalation) and explosions, and help regulate pressure. Offshore rigs include a gas flare for flaring unprocessed natural gas. A gas flare is a gas combustion device that includes burners to burn the combustible gases. First, the gases may be separated from the liquids and solids and then sent to a flare or flare stack where the gas is burned and released into the atmosphere.

SUMMARY

In one aspect, embodiments disclosed herein relate to an apparatus for collecting spilled liquid hydrocarbons including a support beam coupled to an oil rig, the support beam positioned below a flare boom, and a spill pan coupled to an end of the support beam, the spill pan positioned below a burner nozzle of the flare boom.

In another aspect, embodiments disclosed herein relate to an apparatus including an offshore rig including a hull, a main deck, and a flare boom coupled to the hull proximate the main deck, the flare boom having a burner nozzle, and an oil spill collector coupled to the offshore rig, the oil spill collector including a support beam coupled to the offshore rig, and a collection device coupled to an end of the support beam and positioned below the burner nozzle.

In another aspect, embodiments disclosed herein relate to a method including coupling an oil spill collector to an offshore rig below a flare boom, the oil spill collector including a support beam coupled to the offshore rig and a collection device coupled to an end of the support beam, positioning the collection device below a burner nozzle of the flare boom such that the collection device is horizontally aligned with the burner nozzle, and collecting spilled liquid hydrocarbons in the collection device from the flare boom.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
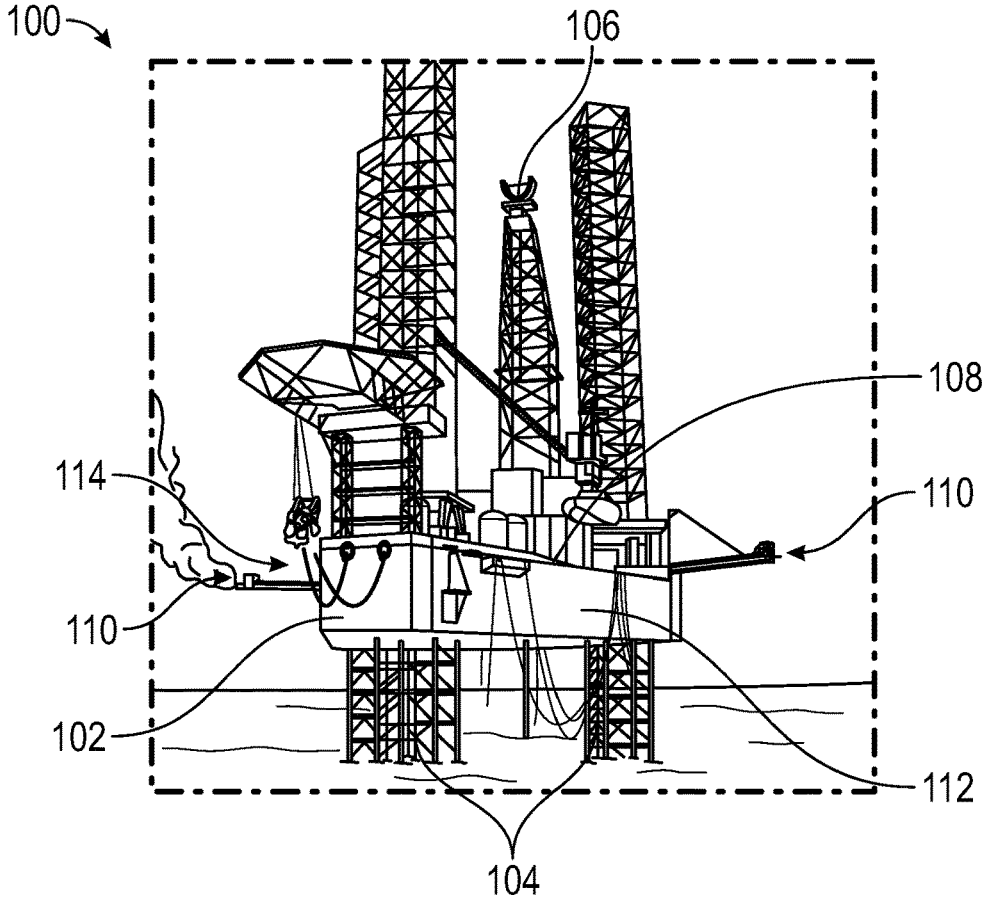
FIG. 1 is a perspective view of an offshore rig in accordance with embodiments disclosed herein.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures.

Embodiments disclosed herein are directed to an apparatus and method for collecting hydrocarbon fluids that may not be combusted during a flaring operation. During flaring operations on offshore rigs, operating companies face concerns of oil falling into the sea below. For example, if a burner nozzle of a flare boom has a nozzle washout, the burner nozzle becomes partially plugged or leaks, or oil or condensate accumulates in a gas pipeline (slug), liquid hydrocarbons may suddenly drop into the sea and cause an oil spill. Such an oil spill could have environmental impacts that could lead to operational shutdown of the oil rig and require an oil spill cleaning operation, both of which can be costly and timely.

Further complications of flaring operations may include restrictions on the time of day such operations may take place. Generally, flaring is often restricted to daylight hours to enable monitoring of the flaring operation to avoid any spills into the sea. Such limited hours of operation of the flares limits optimization of the flaring operations.

One or more embodiments disclosed herein, therefore, relate to an apparatus and method for collecting liquid hydrocarbons from a flare on an offshore rig to reduce or prevent hydrocarbon fluids from falling into the sea. In accordance with one or more embodiments, an apparatus for collecting spilled liquid hydrocarbons may include a collection device, such as a spill pan, coupled to an end of a support beam extending from an oil rig. The collection device may be positioned below a flare boom extending from the oil rig. The position of the device is such that any liquid hydrocarbons that fall from the flare (i.e., from or proximate the burner nozzles coupled to the flare boom) will be collected by the collection device. Liquid hydrocarbons collected in the collection device may then be returned to the oil rig via, for example, a flow line and pump.

Referring to FIG. 1, a perspective view of an offshore rig 100 is shown. In one or more embodiments, offshore rig 100 may be a jackup rig as shown. However, in other embodiments, offshore rig 100 may be a barge rig, a submersible rig, or other types of offshore rigs. As shown, offshore rig 100 includes a hull 102 supported by one or more legs 104. For example, as shown in FIG. 1, offshore rig 100 may include three legs 104. However, one of ordinary skill in the art will appreciate that the offshore rig 100 may have few or more legs 104, such as four, six, or eight legs. In one or more embodiments, the hull 102 may be a buoyant hull to allow for transportation of the hull 102 to a desired location. For example, the hull 102 may be a water-tight barge. The hull 102 may then be raised or lowered to a desired elevation above the surface of the sea and supported by the one or more legs 104.

Figure 2:
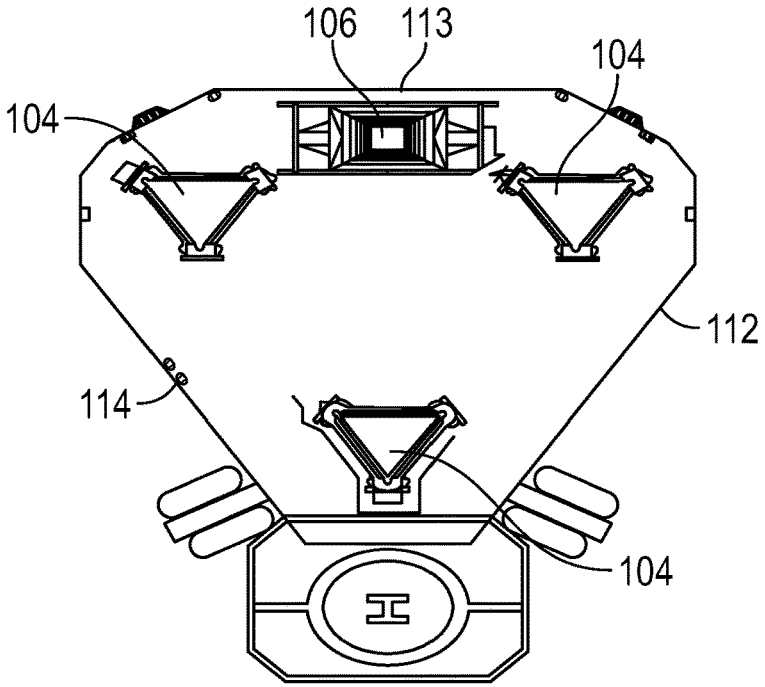
FIG. 2 is a top view schematic of an offshore rig in accordance with embodiments disclosed herein.

A derrick 106 extends from a rig main deck 108 of the offshore rig 100 for supporting a drill string (not shown). As shown, the derrick 106 may be located toward an aft portion 113 (FIG. 2) of the rig main deck 108. FIG. 2 shows a top view schematic of an offshore rig 100 in accordance with embodiments disclosed herein. Referring to FIGS. 1 and 2, the offshore rig 100 includes a flare boom 110. In some embodiments, the offshore rig 100 may include two more or flare booms 110. A first flare boom 110 may extend from a port side 112 of the offshore rig 100. A second flare boom 110 may extend from a starboard side 114 of the offshore rig 100.

Figure 3:
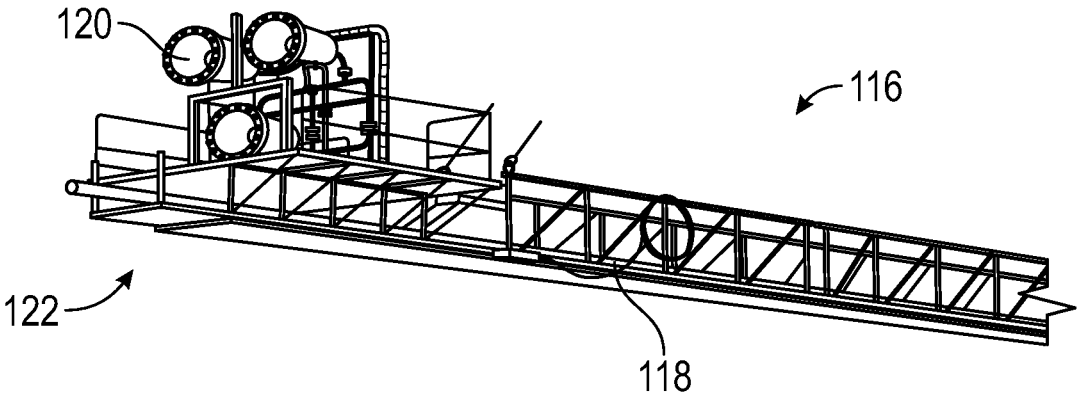
FIG. 3 is a perspective view of a flare boom in accordance with embodiment disclosed herein.
Figure 4:
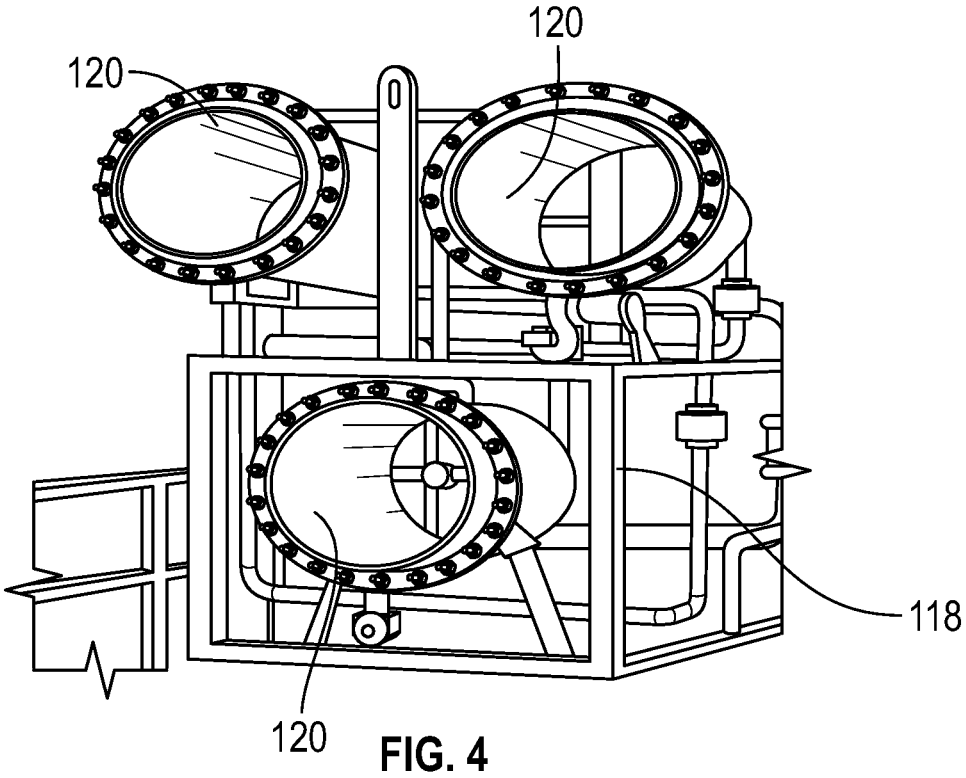
FIG. 4 is a perspective view of burner nozzles of a flare boom in accordance with embodiments disclosed herein.

The flare boom 110 includes a truss structure 116, as shown in FIG. 3, that is coupled to the hull 102. The truss structure 116 ensures the flare is maintained a distance from the offshore rig 100 for safety. The flare boom 110 may extend horizontally out from the hull 102 at the rig main deck 108. In other words, the flare boom 110 may be vertically aligned with the rig main deck 108. A pipeline 118 is carried by the truss structure 116 to connect to a pipeline (not shown) on the offshore rig 100 to a burner nozzle 120 of the flare boom 110. The burner nozzle 120 is located at an end 122 of the flare boom 110, the end 122 being opposite an end of the flare boom 110 coupled to hull 102. In accordance with one or more embodiments, more than one burner nozzle 120 may be coupled to the end 122 of the flare boom 110, as shown in FIG. 4. In some embodiments, three, four, or any suitable number of burner nozzles 120 may be used. An atomizer (not shown) may also be included on the flare boom 110 to convert any oil stream into small droplets to help burning of liquid hydrocarbons.

Figure 5:
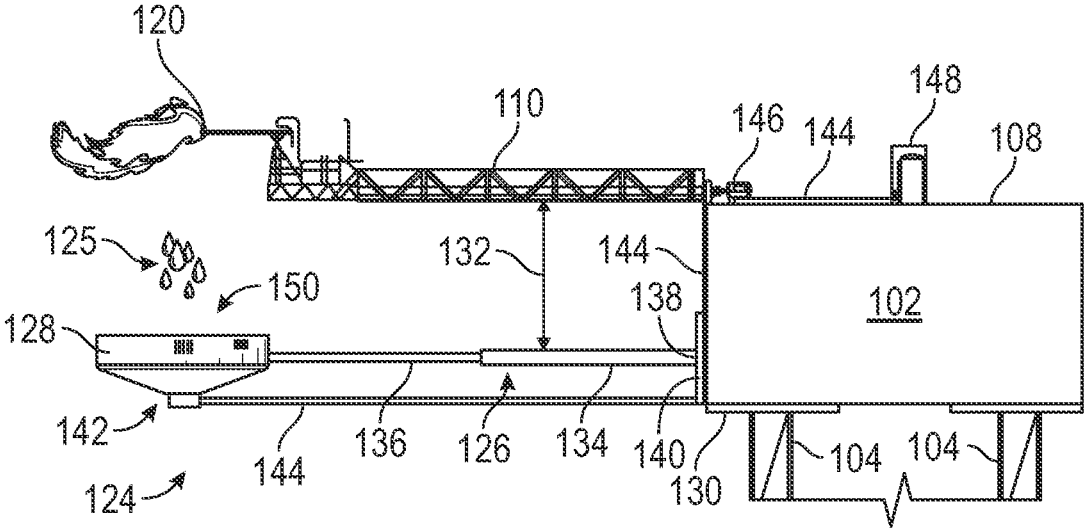
FIG. 5 is side view of an oil spill collector coupled to an offshore rig in accordance with embodiments disclosed herein.

Referring to FIG. 5, the offshore rig 100 in accordance with embodiments disclosed herein further includes an oil spill collector 124 for catching or collecting any of the droplets 125 of oil that are not burned by the burner nozzles 120. For example, if a flare boom 110 burner nozzle 120 has a nozzle washout, the burner nozzle 120 becomes partially plugged or leaks, or oil or condensate accumulates in a gas pipeline (slug), hydrocarbon fluids or oil droplets may suddenly drop from the flare boom 110. Oil spill collector 124 is configured to catch and collect falling hydrocarbon liquids before they reach the sea.

As shown in FIG. 5, oil spill collector 124 includes a support beam 126 coupled to the offshore rig 100 and a collection device 128, e.g., a spill pan, coupled to an end of the support beam 126. The support beam 126 is positioned a distance below the flare boom 110 and the collection device 128 is positioned below the burner nozzle(s) 120. In one or more embodiments, the support beam 126 is coupled to a side of the hull 102 and extends horizontally outward from the offshore rig 100. In some embodiments, the support beam 126 is coupled to a port side (112, FIG. 2) of the hull 102. In some embodiments, the support beam 126 is coupled to the starboard side (114, FIG. 2) of the hull 102. In some embodiments, one support beam 126 may be coupled to the port side (112, FIG. 2) and one support beam 126 may be coupled to the starboard side (114, FIG. 2) of hull 102, such that one support beam 126 corresponds to each flare boom 110 of the offshore rig 100. The support beam 126 may also include a base 140 that is coupled to the side of the hull 102 and provides structural support for the cantilevered structure of the support beam 126.

In one or more embodiments, the support beam 126 may be coupled to the hull 102 at a location proximate a lower surface 130 of the hull 102. As shown in FIG. 5, the flare boom 110 is coupled to the hull 102 at or proximate the rig main deck 108. The rig main deck 108 corresponds to an upper surface of the hull 102. The support beam 126 is coupled to a side (e.g., port or starboard) of the hull 102 proximate the lower surface 130 of the hull 102. In one or more embodiments, the support beam 126 may be coupled to the hull 102 below the flare boom 110 and extend outwardly from the hull 102 such that the support beam 126 extends parallel to the flare boom 110. In one or more embodiments, the support beam 126 may be coupled to the side of the hull 102 in a position that is not directly below the flare boom 110 and may extend at an angle with respect to the side of the hull 102, such that the collection device 128 is positioned directly below the burner nozzle(s) 120. The location or positioning of the collection device 128 may be adjustable to ensure the collection device 128 is horizontally aligned (i.e., directly below or having similar positioning in the horizontal direction) with the burner nozzle(s) 120, as discussed further below.

The positioning of the support beam a distance below the flare boom 110 provides an air gap 132 between the burner nozzle(s) 120 and liquid hydrocarbons or oil collected in the collection device 128. The air gap 132 helps ensure that collected liquid hydrocarbons are sufficiently distanced from the burner nozzle(s) 120 and resulting flames so that the collected liquid hydrocarbons do not combust within the oil spill collector 124. The height of the air gap, i.e., a vertical distance between the flare boom 110 and the support beam 126, may be selected based on a size of the hull 102 of a particular offshore rig 100 and a distance determined to ensure flames of the burner nozzle(s) 120 cannot reach the oil spill collector 124. For example, in one example, hull 102 may have a height of approximately 20 ft (6 m) and the oil spill collector 124 may have a height of approximately 3 ft (1 m) and be positioned on the side of the hull 102 proximate the lower surface 130 of the hull 102. Thus, in this example, height of the air gap is approximately 17 ft (5 m). However, one of ordinary skill in the art will appreciate that the length of the air gap may vary and may be between, 10 ft (3 m) and 15 ft (4.5 m), 15 ft (4.5 m) and 18 ft (5.5 m), or 18 ft (5.5 m) and 20 ft (6 m).

In accordance with one or more embodiments, the support beam 126 may be a hydraulic beam such that the support beam 126 may be hydraulically actuated, including extended or retracted horizontally, or moved vertically. For example, in one embodiment, as shown in FIG. 5, support beam 126 may include a first boom 134 and a second boom 136, the first boom coupled to the hull 102 and the second boom 136 configured to extend outward from the first boom 134 and to be retracted within first boom 134 via hydraulics. In other words, in this example, the second boom 136 may move telescopically with respect to the first boom 134. A hydraulic cylinder (not shown) or hydraulic ram (not shown) may be coupled to support beam 126 to move the second boom 136 with respect to the first boom 134. Thus, the support beam 126 may be extended to increase or retracted to reduce a distance between the collection device 128 coupled to the end of the support beam 126 and the hull 102. Additionally, in one or more embodiments, the support beam 126 may be coupled to the hull 102 such that the end of the support beam 126 may be raised and lowered vertically about a connection point 138 between the support beam 126 and the hull 102. In other embodiments, the support beam may be rigidly coupled to the hull 102.

The collection device 128 is coupled at or proximate to the end of the support beam 126. Generally, in one or more embodiments, the collection device 128 is an open topped structure configured to receive and collect liquid hydrocarbons falling from a burner nozzle(s) 120 and/or an end of the flare boom 110. The collection device 128 may be shaped so as to collect the liquid hydrocarbons and funnel the liquid down toward a bottom 142 of the collection device 128. For example, the collection device 128 may be cylindrical and/or conical in shape, or may be any other suitable shape that is deep enough to avoid oil splatter of the collected oil. A suction line 144 may be coupled to the bottom 142 of the collection device 128 to drain the liquid hydrocarbons from the collection device 128 and return the liquid hydrocarbons to the offshore rig 100. A suction pump 146 disposed on the offshore rig 100, for example, on the rig main deck 108, may be coupled to the suction line 144 to draw the liquid hydrocarbons from the collection device 128 and pump the collected liquid hydrocarbons back up to the rig main deck 108. Once on the rig main deck 108, the liquid hydrocarbons may be pumped into a surge tank 148, processed, or returned to the flare boom 110 for combustion. The suction line 144 may be manufactured from heat resistant alloys, such as iron, nickel, and/or cobalt, to withstand high temperatures of the collected liquid hydrocarbons after passing through the burner nozzle 120.

The suction line 144, coupled to the bottom of the collection device 128, may extend from the collection device 128 to the hull 102 along the support beam 126. For example, as shown, the suction line 144 may be positioned below the support beam 126 and may be coupled at various locations along the hull 102 as the suction line 144 returns the collected liquid hydrocarbons to the rig main deck 108. The suction line 144 may also be coupled at one or more locations along a length of the support beam 126. In one or more embodiments, a length of the suction line 144 may be varied to accommodate extension and retraction of the support beam 126 during positioning of the collection device 128 with respect to the flare boom 110. A diameter of the heat suction line 144 may be selected based on, for example, the length of the flare boom 110, and, therefore, the length of the suction line 144 extending from the hull 102, or a desired flow rate through the suction line 144. In one example, the diameter of the suction line 144 may be approximately 4 in (10 cm). However, in other examples, the diameter may be approximately 2 in (5 cm), 3 in (7.5 cm), 5 in (12.7 cm), etc.

The collection device 128 may be coupled to the end of the support beam 126 by any means known in the art, such as welding, mechanical fasteners, etc. The collection device 128 includes an open top 150 and a coupling for the suction line 144 at or near a bottom of the collection device 128. The collection device 128 may be manufactured from heat resistant alloys, such as iron, nickel, and/or cobalt, to withstand high temperatures of the collected liquid hydrocarbons after passing through the burner nozzle 120.

Figure 6:
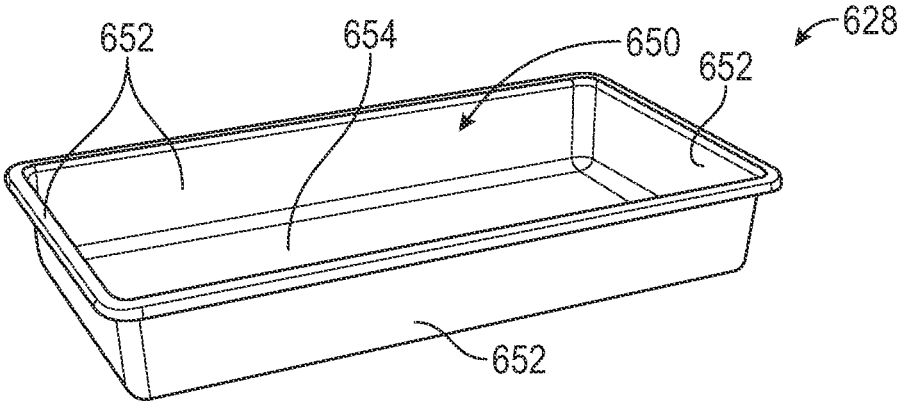
FIGS. 6-8 are perspective views of examples of a collection device in accordance with embodiments disclosed herein.
Figure 7:
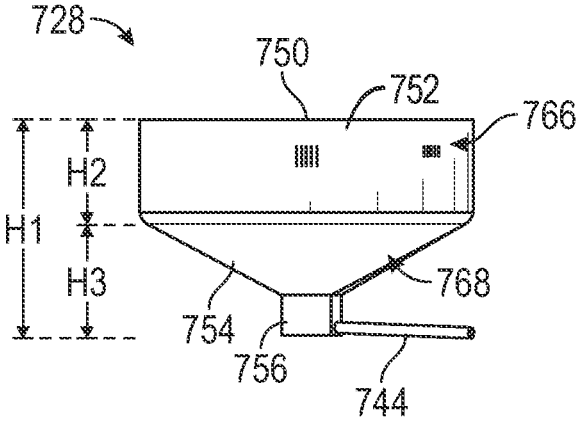
Figure 8:
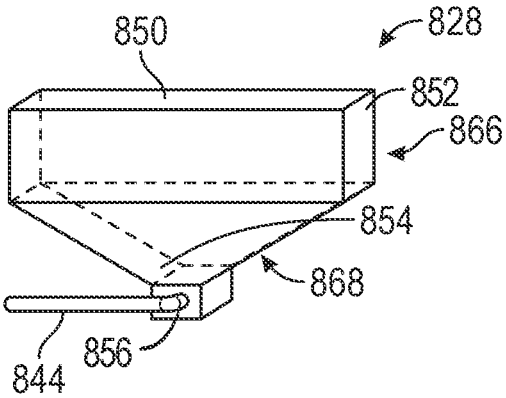

FIGS. 6-8 show examples of collection devices in accordance with embodiments disclosed herein. FIG. 6 shows a collection device 628 in the form of a simple spill pan. As, shown, the collection device 628 may be a generally rectangular prism in shape with four vertically straight sidewalls 652, a flat or slightly sloped bottom 654, and an open top 650. An opening (not shown) or outlet may be located in a center or off-center location of the sloped bottom 654 or formed in a sidewall 652 of the collection device 628. The suction pipe (144, FIG. 5) may then be coupled to the collection device 628 via the opening. The size of the collection device 628 may vary depending on, for example, the size of the support beam (126, FIG. 5), the size or number of burner nozzles (120, FIG. 5), and the size of the hull (102, FIG. 5). In one embodiment, by way of example, the collection device 628 having a rectangular shape may have a length of approximately 13 ft (4 m), a width of 6.5 ft (2 m), and a depth 1.5 ft (0.5 m). However, one of ordinary skill in the art will appreciate that a collection device may have other dimensions of length, width, and depth without departing from the scope of embodiments herein.

FIG. 7 shows a collection device 728, e.g., a spill pan, that includes a first section 766 and a second section 768, the second section 768 positioned below the first section 766, in accordance with one or more embodiments. The first section 766 includes a generally vertically straight sidewall 752 and the second section 768 includes a sloped bottom 754. The vertically straight sidewall 752 forms a generally cylindrical shape, such that an open top 750 of the collection device 728 is generally circular. In one or more embodiments, the sloped bottom 754 of the collection device 728 has a generally conical shape, such that the bottom 754 slopes downward toward a middle of the bottom 754. The collection device 728 includes an outlet 756 that is coupled to a suction line 744 for pumping fluid out of the collection device 728 to, for example, the surge tank (148, FIG. 5). The outlet 756 may be positioned in the middle of the bottom 754 of the second section 768. In one or more embodiments, the bottom 754 may be sloped toward an off-center location of the bottom 754 and the outlet 756 may then be located in that off-center location. In one or more embodiments, the first section 766 of the collection device 728 may include a generally frustoconical sidewall 752, such that the sidewall 752 slopes inwardly from the open top 750 to the second section 768 of the collection device 728, to facilitate flow of the liquid hydrocarbons toward the outlet 756.

The first and second sections 766, 768 of the collection device 728 may be manufactured separately or integrally formed. The size of the collection device 728 may vary depending on, for example, the size of the support beam (126, FIG. 5), the size or number of burner nozzles (120, FIG. 5), and the size of the hull (102, FIG. 5). In one embodiment, by way of example, the collection device 728 may have a height H1 of approximately 3 ft (1 m), wherein each of the first section 766 and the second section 768 has a height H2, H3, respectively of approximately 1.5 ft (0.5 m).

FIG. 8 shows a collection device 828, e.g., a spill pan, similar to the collection device 728 in FIG. 7, that includes a first section 866 and a second section 868, the second section 868 positioned below the first section 866, in accordance with one or more embodiments. The first section 866 includes a generally vertically straight sidewall 852 and the second section 868 includes a sloped bottom 854. The vertically straight sidewall 852 forms a generally rectangular prism shape, such that an open top 850 of the collection device 828 is generally rectangular. In one or more embodiments, the sloped bottom 854 of the collection device 828 has a generally square-based pyramid shape, such that the bottom 854 slopes downward toward a middle of the bottom 854. The collection device 828 includes an outlet 856 that is coupled to a suction line 844 for pumping fluid out of the collection device 828 to the surge tank (148, FIG. 5). The outlet 856 may be positioned in the middle of the bottom 854 of the second section 868. In one or more embodiments, the bottom 854 may be sloped toward an off-center location of the bottom 854 and the outlet 856 may then be located in that off-center location. In one or more embodiments, the first section 866 of the collection device 828 may include a sloped sidewall 852, such that the sidewall 852 slopes inwardly from the open top 850 to the second section 868 of the collection device 828, to facilitate flow of the liquid hydrocarbons toward the outlet 856.

The first and second sections 866, 868 of the collection device 828 may be manufactured separately or integrally formed. The size of the collection device 828 may vary depending on, for example, the size of the support beam (126, FIG. 5), the size or number of burner nozzles (120, FIG. 5), and the size of the hull (102, FIG. 5). In one embodiment, by way of example, the collection device 828 may have a height of approximately 3 ft (1 m), wherein each of the first section 866 and the second section 868 has a height of approximately 1.5 ft (0.5 m).

Figure 9:
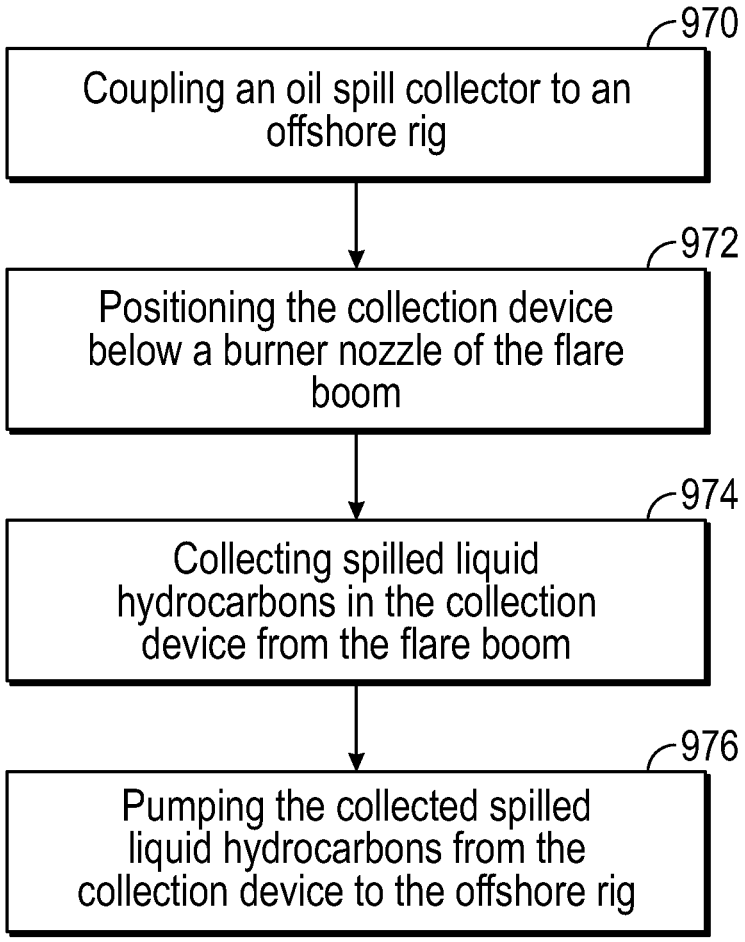
FIG. 9 is a flow chart of a method in accordance with embodiments disclosed herein.

A method in accordance with embodiments disclosed herein is shown in FIG. 9. In accordance with one or more embodiments, a method of collecting spilled liquid hydrocarbons from a flare of an offshore rig includes coupling an oil spill collector to an offshore rig, shown at 970. The oil spill collector includes a support beam coupled to the offshore rig and a collection device coupled to an end of the support beam, as described above with respect to FIGS. 5-8. The collection device may be positioned below a burner nozzle of the flare coupled to the flare boom, shown at 972. The positioning of the collection device may be facilitated by movement of the flare boom. Specifically, in one or more embodiments, the flare boom is a hydraulic boom having a first boom and a second boom. The collection device may, therefore, be positioned below and in horizontal alignment with the burner nozzle by hydraulically extending the second boom of the support beam from a first boom of the support beam. The second boom may also be retracted into the first boom of the support beam to adjust the positioning of the collection device with respect to the burner nozzle.

The method further includes collecting spilled liquid hydrocarbons in the collection device that are not burned from the flare boom, as shown at 974. Positioning of the collection device below the burner nozzle of the flare boom such that the collection device is aligned with the burner nozzle in a horizontal direction ensures that falling liquid hydrocarbon droplets are collected in the collection device and do not reach the sea.

The oil spill collector may further include a suction line coupled to an outlet of the collection device and a suction pump coupled to the suction line. In accordance with one or more embodiments disclosed herein, the method may further include pumping the collected spilled liquid hydrocarbons with the pump to move the collected spilled liquid hydrocarbons from the collection device to a tank on the offshore rig, as shown at 976. The support beam is located or positioned such that the collection device is spaced vertically below the flare boom a distance to provide an air gap between a flare of the burner nozzles and the collected spilled liquid hydrocarbons. The air gap ensures a safe distance between the flare and the collected spilled liquid hydrocarbons to prevent the collected spilled liquid hydrocarbons from combusting within the oil spill collector.

Embodiments disclosed herein may advantageously provide an apparatus and method for collecting spilled liquid hydrocarbons that fall from a flare boom without combusting from a flare. Embodiments disclosed herein may provide an apparatus and method that help prevent liquid hydrocarbons from falling into the sea and thereby prevent an oil spill. Thus, embodiments disclosed herein may help prevent environmental pollution. Additionally, embodiments disclosed herein may provide increased time for flaring operations on an offshore rig. For example, the protection from an oil spill provided by an oil spill collector as disclosed herein may allow for flaring operations to be run during non-daylight hours, or 24 hrs a day continuously, which may optimize the flaring operation.

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. An oil rig with an apparatus for collecting spilled liquid hydrocarbons, comprising:
- a flare boom and a burner nozzle mounted on the flare boom,
- wherein the apparatus comprises:
  - a support beam having a first beam end and a second beam end, wherein the first beam end is coupled to the oil rig, and wherein the support beam is positioned below and is independent from the flare boom;
  - a spill pan coupled to the second beam end of the support beam, wherein the spill pan is positioned below the burner nozzle; and
  - a suction line coupled to an outlet in the spill pan.

2. The oil rig of claim 1, wherein the spill pan comprises a vertical sidewall and a sloped bottom.

3. The oil rig of claim 2, wherein the outlet is disposed in the bottom of the spill pan.

4. The oil rig of claim 3, further comprising a suction pump fluidly coupled to the suction line and a surge tank fluidly coupled to the suction line and the suction pump.

5. The oil rig of claim 1, wherein the spill pan comprises a first section having a vertical, cylindrically shaped sidewall, and a second section having a conical shape.

6. The oil rig of claim 1, wherein the spill pan comprises a first section having a vertical, rectangular prism shaped sidewall, and a second section having a square-based pyramid shape.

7. The oil rig of claim 1, wherein the support beam comprises a first boom and a second boom.

8. The oil rig of claim 7, wherein the support beam is hydraulically actuated to telescopically move the second boom with respect to the first boom.

9. An apparatus comprising:
- an offshore rig including a hull, a main deck, a flare boom, and a burner nozzle,
- wherein the flare boom has a first boom end and a second boom end,
- wherein the first boom end is coupled to the hull proximate the main deck such that the flare boom extends from the hull, and wherein the burner nozzle is mounted to the second boom end;

an oil spill collector coupled to the offshore rig, the oil spill collector comprising:

a support beam having a first beam end coupled to the offshore rig, wherein the support beam is positioned below and is independent from the flare boom, and a collection device coupled to a second beam end of the support beam, wherein the collection device is positioned below the burner nozzle, and a suction line coupled to an outlet in the collection device.

10. The of claim 9, further comprising a surge tank and a suction pump fluidly coupled to the suction line.

11. The of claim 9, wherein the support beam comprises a hydraulic beam.

12. The of claim 11, wherein the hydraulic beam is configured to move the collection device horizontally and vertically.

13. The of claim 12, wherein the hydraulic beam comprises a first boom and a second boom, wherein the second boom moves telescopically with respect to the first boom.

14. The of claim 9, wherein the oil spill collector is positioned a distance below the flare boom, thereby providing an air gap.

15. The of claim 9, wherein the oil spill collector is connected to at least one of a port side or a starboard side of the hull.

16. A method for collecting spilled liquid hydrocarbons from an oil rig having a flare boom and a burner nozzle mounted on the flare boom, the method comprising:

coupling an oil spill collector to the oil rig, the oil spill collector comprising a support beam comprising a first beam end coupled to the oil rig and a second beam end coupled to a collection device;

positioning the collection device below the burner nozzle of the flare boom such that the collection device is horizontally aligned with the burner nozzle, and wherein the support beam is independent from the flare boom;

collecting spilled liquid hydrocarbons that are spilled from the burner nozzle in the collection device, and returning the spilled liquid hydrocarbons to the oil rig through a suction line coupled to an aperture in the collection device.

17. The method of claim 16, wherein positioning the collection device comprises hydraulically extending a second boom of the support beam from a first boom of the support beam.

18. The method of claim 16, wherein positioning the collection device comprises providing an air gap between the flare boom and the support beam.

* * * * *